United States Patent [19]

Petersen et al.

[11] 4,207,073

[45] Jun. 10, 1980

[54] TEXTILE FINISH AND PROCESSES FOR ITS PREPARATION AND USE

[75] Inventors: Harro Petersen, Frankenthal, Fed. Rep. of Germany; Panemangalore S. Pai; Manfred Reichert, both of Charlotte, N.C.

[73] Assignee: BASF Aktiengesellschaft, Fed. Rep. of Germany

[21] Appl. No.: 815

[22] Filed: Jan. 4, 1979

[51] Int. Cl.[2] ..... D06M 15/54

[52] U.S. Cl. ..... 8/187; 8/185; 252/8.8; 260/29.4 R; 560/160

[58] Field of Search ..... 8/187, 185; 560/160; 260/29.4 R, 849; 252/8.8

[56] References Cited

U.S. PATENT DOCUMENTS

| | | | |
|---|---|---|---|
| 3,524,876 | 8/1970 | Gregson | 8/187 |
| 3,990,847 | 11/1976 | Shenoy et al. | 8/187 |

FOREIGN PATENT DOCUMENTS

| | | | |
|---|---|---|---|
| 2620010 | 1/1977 | Fed. Rep. of Germany | 8/187 |
| 1523308 | 8/1978 | United Kingdom | 560/160 |

*Primary Examiner*—John Kight, III
*Attorney, Agent, or Firm*—Keil & Witherspoon

[57] ABSTRACT

A process for the preparation of a textile finish, the textile finish thus obtained and its use for the easy-care finishing of textiles containing, or consisting of, cellulose. The textile finish comprises an aqueous solution, of from 30 to 70 percent strength by weight, of a mixture of the conventionally formaldehyde-methylolated carbamates I and II

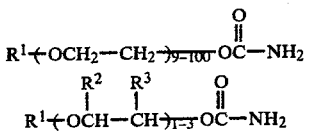

I

II where $R^1$ is hydrogen or alkyl of 1 to 4 carbon atoms and $R^2$ and $R^3$ are hydrogen, or one is hydrogen and the other is methyl, in the weight ratio I:II of from 12:1 to 1:20.

The textile finish is prepared by reacting a glycol or an alkylglycol of the formulae III and IV

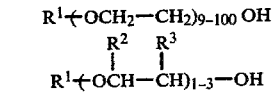

III

IV where $R^1$, $R^2$ and $R^3$ have the above meanings, with urea at above 100° C., so as to eliminate ammonia and give carbamates, and subsequent conventional methylolation with formaldehyde, wherein, in a first stage, the glycol or alkylglycol of the formula III is reacted to the extent of at least 50% with urea, in the absence of a catalyst, at from 130° to 160° C., to give the carbamate I, and in a second stage, carried out either in the presence of an ion exchanger, containing nickel ions, as the catalyst, at from 130° to 165° C., or in the absence of a catalyst at from 150° to 200° C., the carbamate mixture in the weight ratio I:II of from 12:1 to 1:20, is prepared by addition of the glycol or alkylglycol of the formula IV and further urea.

3 Claims, No Drawings

TEXTILE FINISH AND PROCESSES FOR ITS PREPARATION AND USE

British Pat. No. 1,523,308 and German Laid-Open Application DOS No. 2,620,010 disclose processes for the preparation of carbamates and carbamate mixtures by reacting alcohols and polyethylene glycols with urea in the presence of an ion exchanger containing nickel ions. It is true that the products thus obtainable are excellent textile finishes but they are brownish or brown, which in most cases is objectionable.

It is an object of the present invention to provide a process, based on easily accessible starting materials, for the preparation of textile finishes which are substantially colorless and which are superior in respect of the totality of their technological properties.

We have found that this object is achieved by the process as claimed in claim 2. The finishes thus obtainable are not only colorless or virtually colorless, but in addition exhibit the following very important properties: good shelf life of the neutral solution, and stability in an acid bath, coupled with good reactivity; high resistance to chlorine, and to hydrolysis, of the finish after application to the textile; good abrasion resistance; a pleasant textile hand even without the addition of a softener; low soiling and soil redeposition; negligible elimination of formaldehyde. Finally, the finished textiles can be printed very easily. The combination of colorlessness and all the above excellent properties, virtually without any offsetting disadvantages, makes the finish obtainable according to the invention a most valuable product.

To carry out the first stage of the reaction, about equimolar amounts (any excess of one or the other component can be compensated in the second stage) of urea and polyethylene glycol III (of which one chain end can be etherified with methanol, ethanol, propanol or butanol, though the free polyethylene glycol, ie. with both chain ends non-etherified, is preferred) of degree of polymerization from 9 to 100, preferably from 9 to 20, are heated in the absence of a catalyst, in a stream of inert gas for the purpose of excluding air and removing the ammonia formed, for several hours (from about 2 to 7 hours, preferably from 3 to 6 hours) at from 130° to 160° C., preferably from 145° to 155° C., whilst stirring. The reaction can be carried out under atmospheric or superatmospheric pressure, continuously or batchwise, with or, preferably, without a solvent. Suitable solvents are relatively high-boiling organic liquids which are inert under the reaction conditions, for example aromatic or araliphatic hydrocarbons, eg. toluene, xylene, ethylbenzene, isopropylbenzene and mixtures of these. After the reaction, any solvent is distilled off.

The reaction takes place in accordance with the equation

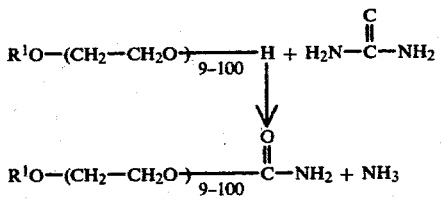

If $R^1$ is H, the reaction of course does not take place entirely in accordance with the above idealized scheme; instead, dicarbamates are also formed, by reaction of both hydroxyl end groups of the polyethylene glycol, whilst some of the glycol does not react at all. However, this is immaterial for the purposes of the present invention and will therefore be disregarded in this specification ie. the term "monocarbamate" will be used though the actual reaction mixture is meant.

When this reaction has taken place to the extent of at least 50%, preferably at least 65%, in particular more than 80% (in the case where $R^1$ is H, 100% is taken to mean the reaction of an average of one of the two hydroxyl groups of the polyethylene glycol; the degree of conversion can be determined from, for example, the residual urea content), the second stage can be started, in which the analogous reaction takes place and the first reaction may or may not be completed.

To carry out the second stage, further urea, the alkylglycol or glycol IV, preferably methylglycol, and the catalyst, if any, are added to the reaction mixture, whilst stirring, and heating of the mixture is continued, advantageously whilst also continuing to pass a stream of inert gas, or under reduced pressure, for from 2 to 40 hours, preferably from 5 to 20 hours, preferably at from 130° to 165° C., especially from 145° to 155° C., in the presence of a catalyst, or at from 150° to 200° C., especially from 160° to 190° C., in the absence of a catalyst, with the lower temperature in each case corresponding to a longer reaction time, and vice versa. The reaction temperature is only of importance inasmuch as discoloration must be expected at excessively high temperatures, whilst at excessively low temperatures the reaction time increases disproportionately. The molar ratio of alkylglycol or glycol IV to urea employed in the 2nd stage is from 1:0.5 to 1:1, preferably about 1:1. If the ratio used is 1:<1, the excess of IV is subsequently distilled off. The ratio of carbamate I to carbamate II is from 12:1 to 1:20, preferably from 1:1 to 1:15, in particular from 1:2.5 to 1:12, the range from 12:1 to about 1:1 being used only in connection with polyester/cotton union fabrics.

The catalyst advantageously employed in the 2nd stage consists of an ion exchanger, as a rule as acidic ion exchanger, preferably an acidic synthetic resin exchanger, which contains nickel ions. Such exchangers are described, for example, in Houben-Weyl, Methoden der Organischen Chemie, Volume I/1, page 528, Table 3. Preferably, exchangers of high or medium acidity are employed, for example phenolsulfonic acid resins or polystyrenesulfonic acid resins, or exchangers containing similar acidic resins, for example bifunctional condensation resins. It is also possible to use styrenephosphonic acid resins, styrenephosphinic acid resins, resorcinol resins and aliphatic or aromatic carboxylic acid resins. Numerous versions of the above cation exchangers are commercially available. Before the reaction, the exchanger is charged with nickel by conventional methods, advantageously by treatment with a solution, preferably an aqueous solution, of a nickel salt. Advantageous nickel salts are nickel chloride, nickel acetate, nickel bromide, nickel nitrate and, preferably, nickel sulfate. The nickel compounds may also be in the form of the corresponding hydrates, for example nickel chloride hexahydrate. However, it is also possible to use, for example, nickel phosphate, nickel carbonate, nickel bicarbonate, nickel borate, nickel oxalate and nickel propionate. Advantageously the exchanger is activated, before treatment with the nickel salt, with an acid, preferably with sulfuric acid or with the acid corresponding to the anion of the nickel salt. Advantageously, the exchanger is first left under water, or in water, at from 15° to 40° C. for from 10 to 30 minutes, is then activated for from 10 to 60 minutes with an acid, advantageously in the form of an aqueous solution of from 2 to 15 percent strength by weight, at from 15° to 40° C., and is finally washed with water until neutral. The treatment with the nickel salt solution is advantageously carried out at from 10° to 50° C., preferably from 20° to 30° C. The reaction can be carried out under atmospheric or superatmospheric pressure, batchwise, for example by a process wherein the reactants are stirred in or charged in, or, preferably, continuously, for example in exchanger columns, by a fixed-bed, fluidized-bed or fluidized-flow method or in a tray column. Advantageously, the nickel salt solutions are of from 5 to 50 percent strength by weight, and the treatment time is from 10 to 60 minutes. It is advantageous subsequently to rinse the product with water until the wash liquor issuing from the exchanger column is neutral, after which the product is washed with one of the above inert solvents or an alcohol for from 10 to 60 minutes at from 15° to 40° C. until substantially anhydrous. Advantageously, each part by weight of exchanger is charged with from 0.01 to 0.2, preferably from 0.02 to 0.1, especially from 0.02 to 0.08, part by weight of nickel, and from 0.01 to 0.25, preferably from 0.02 to 0.1, part by weight of exchanger is used per part by weight of urea.

It is true that in principle a nickel salt may also be used as the catalyst, instead of the ion exchanger containing nickel ions, but the ion exchangers can be much more easily separated from the reaction product by filtration, or by sedimentation, than can the salts (which would have to be precipitated as the hydroxide).

It suffices if the starting materials are of technical-grade purity.

After conclusion of the second stage, the reaction mixture can be cooled to about 70° C. and the catalyst can be separated off, advantageously by filtration. Thereafter, any excess methylglycol is distilled off, if appropriate under reduced pressure.

The carbamate mixture thus obtained is then methylolated in the conventional manner in order to convert it to the desired textile finish. For this purpose, it is treated with excess aqueous formaldehyde solution at a pH of from 7.5 to 11, preferably from 8.5 to 10, for from one to 10, preferably from 2 to 5, hours at from 10° to 80° C., preferably from 30° to 60° C. The solution is then neutralized with any water-soluble acid, for example sulfuric acid, after which it may or may not be diluted with water to the desired concentration. If necessary, the solution can be filtered, with or without the use of a filtration aid, eg. active charcoal.

The resulting almost colorless or completely colorless, clear, aqueous solution is the ready-to-use textile finish. It is marketed as a concentrated solution (of from 30 to 70% strength by weight) having a pH of from 5 to 8, preferably from 6 to 7.5, and, before use, can be diluted as desired, acidified, and mixed with catalysts and other assistants, with other finishes, or with pigments, plasticizers and the like. It is used for providing a shrink-resistant and wrinkle-resistant, and hence easy-care, finish on textiles which contain, or consist of, natural or regenerated cellulose.

In the Examples, parts and percentages are by weight, unless stated otherwise.

EXAMPLE 1

(a) Preparation of the nickel-containing catalyst

A column is filled with 1,000 parts of a commercial cation exchanger consisting of sulfonated crosslinked polystyrene and is left to stand in the presence of 1,000 parts of water for 15 minutes. 500 parts of 10 percent strength hydrochloric acid are then added, after which the column is left to stand for 20 minutes and the exchanger is washed neutral with distilled water. 3,400 parts of a 10 percent strength solution of $NiSO_4.7\ H_2O$ are added to the exchanger which has been activated as described above. When the solution leaving the column is no longer acidic, the absorption of the nickel ion is complete. The exchanger is washed neutral with water, then washed with methanol until free from water, and dried. At this stage, the exchanger is ready to use and contains 8–8.5 parts of nickel per 100 parts of exchanger.

(b) Preparation of a co-carbamate of polyethylene ether-diol (=polyethylene glycol) $H(OCH_2CH_2)_{18}OH$, methylglycol (=ethylene glycol monomethyl ether) and urea.

A mixture of 276 parts of polyethylene ether-diol having a molecular weight of 810 ($H(OCH_2CH_2)_{18}OH$) and 21 parts of urea is heated, in a stirred apparatus equipped with a reflux condenser and gas inlet tube, for three hours at 145° C., whilst stirring and at the same time passing a stream of nitrogen through the apparatus. After this time the conversion is 65% (measured by determining the residual urea content). 472 parts of methylglycol, 373 parts of urea and 31 parts of a commercial cation exchanger which has been treated as described under 1(a) above are then added. The reaction mixture is refluxed for 15 hours (maximum temperature 150° C.) whilst stirring, and passing a stream of nitrogen through the apparatus. The reaction solution is then cooled to 120° C. and the exchanger is filtered off. 936 parts of a co-carbamate are obtained. This corresponds to a yield of 91% of theory. The residual urea content is 0.4%.

(c) Conversion of the methylolated mixture 785 parts of the co-carbamate obtained as described in Example 1(b) are heated, in a stirred apparatus, with 634 parts of 40% strength formaldehyde solution and 17 parts of 50% strength sodium hydroxide solution for 3 hours at 50° C.

The mixture is then neutralized with dilute sulfuric acid. 1,450 parts of a 68% strength solution are obtained. The free formaldehyde content is 2.2%. A 50% strength solution is obtained by adding 570 parts of water.

EXAMPLE 2

300 parts of a polyethylene ether-diol having a molecular weight of 600 and 30 parts of urea are heated for three hours at 150°–155° C. in a stirred apparatus, whilst passing a stream of nitrogen through the apparatus. The degree of conversion is 90%. 68.4 parts of methylglycol, 54 parts of urea and 35 parts of a nickel-containing exchanger obtained as described in Example 1(a) are then added. The reaction mixture is refluxed for 18 hours (maximum temperature 155° C.), whilst stirring. After the mixture has cooled to 110°–120° C., the exchanger is filtered off. 401 parts of the co-carbamate, having a residual urea content of 0.3%, are obtained. This corresponds to a yield of 94%.

The methylolation is carried out as described in Example 1.

EXAMPLE 3

600 parts of a polyethylene ether-diol having a molecular weight of 4,000 and 9 parts of urea are heated for 3 hours at 150°-155° C. in a stirred apparatus. A degree of conversion of 90% is reached. After adding 31.8 parts of diethylene glycol, 18 parts of urea and 4.5 parts of a nickel-containing exchanger prepared as described in Example 1(a), the reaction mixture is heated for 15 hours at 155° C., whilst passing a stream of nitrogen through the apparatus. The mixture is then cooled to 110° C. and the exchanger is filtered off. 611 parts (94% of theory) of the co-carbamate are obtained. The residual urea content is 0.25%.

611 parts of the co-carbamate thus obtained and 61 parts of 40% strength formaldehyde solution are heated, after adding 3 parts of 50% strength sodium hydroxide solution, for 3 hours at 50°-55° C. in a stirred apparatus. After adding 400 parts of water and neutralizing with dilute sulfuric acid, 1,080 parts of a 58% strength solution of the methylol compound, containing 1.7% of free formaldehyde, are obtained.

EXAMPLE 4

810 parts of the polyethylene ether-diol $H(OCH_2CH_2)_{18}OH$ and 60 parts of urea are heated for 3 hours at 150° C. in a stirred apparatus, whilst passing a stream of nitrogen through the apparatus. A degree of conversion of 85% is reached. 2,158 parts of methylglycol, 1,065 parts of urea and 94 parts of a nickel-containing ion exchanger, prepared as described in Example 1(a), as the catalyst are then added. The reaction mixture is refluxed whilst passing a stream of nitrogen through the apparatus. The reflux temperature is initially 132°-134° C. and rises to 150° C. in the course of 5 hours. The mixture is then heated at 150° C. for a further 10 hours. When the mixture has cooled to 90° C., the catalyst is filtered off. At about 100° C., the excess methylglycol is distilled off under reduced pressure. 2,700 parts of a co-carbamate of 30% of polyethylene ether-diol monocarbamate and 70% of methoxyethyl carbamate are obtained. This corresponds to a yield of 92% of theory. The residual urea content is 0.2%.

2,700 parts of the co-carbamate, 2,200 parts of 40% strength formaldehyde solution and 30 parts of 50% strength sodium hydroxide solution are heated for 3 hours at 50°-55° C. in a stirred apparatus. After neutralizing the mixture with 25 parts of dilute sulfuric acid, 1,780 parts of water are added. 6,735 parts of a 51% strength solution of the methylolation mixture (hereinafter referred to as "dimethylol co-carbamate"), containing 1.8% of free formaldehyde, are obtained.

EXAMPLE 5

810 parts of a polyethylene ether-diol $H(OCH_2CH_2)_{18}OH$ and 60 parts of urea are heated for 6 hours at 150° C., whilst passing a vigorous stream of nitrogen through the apparatus. 845 parts of the monocarbamate (or of the reaction mixture referred to as such) are obtained, the residual urea content being only 0.1%. This corresponds to a yield of 99% of theory. Thereafter, 4,240 parts of diethylene glycol ($HOCH_2CH_2OCH_2CH_2OH$) and 2,400 parts of urea are admixed and the batch, without a catalyst, is heated for 5 hours at 180° C. whilst stirring and passing a vigorous stream of nitrogen through the apparatus. The yield is 5,900 parts of diethylene glycol monocarbamate (=99% of theory).

The two carbamates, together with 4,800 parts of 40% strength formaldehyde solution, are heated for 3 hours at 50°-55° C., 55 parts of 50% strength sodium hydroxide solution being added. After neutralizing the mixture with dilute sulfuric acid, 5,700 parts of water are added. 17,300 parts of a 50% strength solution of the methylolation mixture, containing 1.9% of free formaldehyde, are obtained.

EXAMPLE 6

590 parts of a polyethylene ether-diol having a molecular weight of 590 ($H(OCH_2CH_2)_{13}OH$) and 60 parts of urea are heated in a stirred apparatus for 4 hours at 150° C., whilst passing a stream of nitrogen through the apparatus. This results in a degree of conversion of 91%. Thereafter, 1,140 parts of methylglycol, 900 parts of urea and 90 parts of the nickel-containing catalyst prepared as described in Example 1(a) are added. The reaction mixture is refluxed, with refluxing starting at about 134°-135° C. The mixture is heated for 15 hours, during which the temperature is not allowed to exceed 155° C. After filtering off the catalyst, 2,320 parts of a co-carbamate mixture, consisting of 25% of polyether diol monocarbamate $H(OCH_2CH_2)_{13}OCONH_2$ and 75% of methoxyethyl carbamate, are obtained. This mixture is hydroxymethylated with 2,160 parts of 40% strength formaldehyde solution, 35 parts of 50% strength sodium hydroxide solution being added, and is subsequently neutralized with dilute sulfuric acid. 4,550 parts of an approximately 65% strength solution of the methylolation mixture, containing 2.6% of free formaldehyde, are obtained.

EXAMPLE 7

810 parts of a polyethylene ether-diol of molecular weight 810 ($H(OCH_2CH_2)_{18}OH$) and 60 parts of urea are heated in a stirred apparatus for 5 hours at 150° C., whilst passing a stream of nitrogen through the apparatus. After this time, the degree of conversion is 92%. Thereafter, 2,680 parts of dipropylene glycol, 1,200 parts of urea and 100 parts of the nickel-containing exchanger prepared as described in Example 1(a) are added. The reaction mixture is heated for 16 hours at 155° C., whilst passing a stream of nitrogen through the apparatus. After the mixture has cooled to about 100° C., the catalyst is filtered off. 4,350 parts of the co-carbamate mixture, consisting of 24% of a polyethylene ether-diol monocarbamate $H(OCH_2CH)_{18}OCONH_2$ and 76% of dipropylene glycol monocarbamate, are obtained.

The mixture of these co-carbamates is hydroxymethylated with 2,800 parts of 40% strength formaldehyde solution at 50° C., 40 parts of 50% strength sodium hydroxide solution being added and the reaction time being 3 hours; thereafter the mixture is neutralized with dilute sulfuric acid. 7,250 parts of a 75% strength solution of the methylolated co-carbamates are obtained.

EXAMPLE 8

428 parts of a monomethyl-polyethylene ether-diol of the formula $CH_3—(OCH_2CH_2)_9OH$ and 60 parts of urea are heated in a stirred apparatus for 3 hours at 145°-150° C., whilst stirring and passing a stream of nitrogen through the apparatus. This results in about 85% conversion to the carbamate. 2,120 parts of diethylene glycol and 1,200 parts of urea are then added. The reaction mixture, without a catalyst, is heated for 6 hours at 190° C., whilst passing a stream of nitrogen through the apparatus. This results in the conversion of all but 0.2% of the urea. 3,420 parts of a co-carbamate are obtained. This corresponds to a yield of 99% of theory. 2,550 parts of 40% strength formaldehyde solution and 40 parts of 50% strength sodium hydroxide solution are added to this co-carbamate mixture, and the batch is stirred for 3 hours at 50°–55° C. After neutralizing with dilute sulfuric acid, 6,070 parts of a 73% strength solution of the methylolated co-carbamate mixture are obtained.

USE EXAMPLES

The Use Examples 9–13 employed the product described in Example 4.

EXAMPLE 9

An aqueous solution is made, containing 7.5% of the dimethylol co-carbamate of Example 4 and 0.18% of basic aluminum chloride. A sample of 50/50 polyester/cotton sheeting fabric (108 g/m$^2$) which has been bleached only is padded with this solution with a wet pick-up of 65%. The swatches are then cured at 205° C. for 20 seconds.

A portion of the above sample is compared with a sample similarly treated with
(a) dimethylol methyl-carbamate
(d) dimethylol methoxyethyl-carbamate
(c) dimethylol 4,5-dihydroxyethylene-urea.

Methylolated polyethylene oxide monocarbamates alone, ie. not in the form of the mixture according to the invention, were not employed at all for comparison, since it is known that because of their high molecular weight they provide insufficient capability of crosslinking with the cellulosic hydroxyl groups, and hence give an insufficient finishing effect (too low a durable press rating, and too high a shrinkage).

Determination of formaldehyde odor in the finished fabric is carried out by the Sealed Jar Method as described in the Association of Textile Chemists and Colorists Test Method 112-1975. This method provides an analytical means for determining the amount of formaldehyde released under conditions similar to those of actual storage. The test is run in duplicate and the average values are reported below.

Finish: Content of free formaldehyde in the fabric
dimethylol co-carbamate resin of Example 4: 160 ppm
dimethylol methyl-carbamate: 690 ppm
dimethylol methoxyethyl-carbamate: 555 ppm
dimethylol 4,5-dihydroxyethylene-urea: 480 ppm From the above Example, it is clear that finishing with the dimethylol co-carbamate of the invention gives less potential for development of formaldehyde odor than the other finishes described above. Thus, from the consumer and garment industry employees' point of view, the reduction in the potent disagreeable odor of formaldehyde in the finished fabric is considered highly beneficial.

EXAMPLE 10

A pad bath formulation is prepared from the following ingredients:

(a)

15.0% of dimethylol co-carbamate solution (50% solids) of Example 4
0.1% of non-ionic wetting agent: p-octylphenol, oxyethylated with ten moles of ethylene oxide
0.18% of activated basic aluminum chloride. $9H_2O$
1.0% of a commercial ion-ionic polyethylene emulsion (25% solids),
the balance being water.

The above is padded onto polyester/cotton (65/35) sheeting fabric at 50–55% wet pick-up from the bath. The fabric is then dried and cured in a tenter frame at 205° C. for 20 seconds. For comparison, samples are similarly padded with:

(b)

15.0% of dimethylol 4,5-dihydroxyethylene-urea (aqueous) solution (50% solids)
0.1% of non-ionic wetting agent
4.0% of a commercial cationic quaternary fatty acid ester softener (20% strength emulsion)
3.0% of zinc nitrate hexahydrate solution (50% solids)

(c)

10.0% of dimethylol 4,5-dihydroxyethylene-urea aqueous solution (50% solids)
0.1% of non-ionic wetting agent
2.0% of a commercial 35% strength anionic emulsion of dimethylpolysiloxane as a softener
0.10% of glacial acetic acid
the remainder being tapwater, at ambient temperature.

The differences in the types and amounts of the catalysts are due to the different requirements to be satisfied for optimum results.

If the fabrics are to be printed after finishing, the absorbency is a factor to be considered. Wettability or absorbency of the fabrics is determined by the AATCC Test Method 79-1975. The shorter the average wetting time, the more absorbent is the textile. Less than 10 seconds is considered good absorbency for fabrics prepared for printing. The novel co-carbamate formulation (a) produced a hydrophilic finish and the data are recorded in the following Table:

| Fabric treatment | Absorbency Time in seconds | |
|---|---|---|
| | not washed | washed |
| finish (a) | 8 | 6 |
| finish (b) | 180 | 180 |
| finish (c) | 180 | 180 |
| no finish - bleached only | 5–6 | |

Thus it is clearly evident from the above that fabrics treated with the finish according to the invention behave favorably as compared with most resin finishes for subsequent printing processes where fabric absorbency is of importance.

EXAMPLE 11

The three formulations (a), (b) and (c) of Example 10 are again used. These formulations are padded onto polyester/cotton (50/50) sheeting fabrics. The fabrics are then flash-cured at 205° C. for 20 seconds.

The fabrics (which are labeled A, B, C) are screen-printed with different patterns using the following printing formulation:

pigment color: 0.1–2%
pigment binder: 10–15%
synthetic thickener: 85%

The fabrics are subsequently dried and cured at 160°–170° C. for 2–3 minutes.

Results (1) Appearance

Fabric A shows superior color yeild and brilliance to fabric B. Fabric B shows a somewhat "washed-out" appearance. Fabric C shows similar color yield to fabric A.

(2) Pattern definitions

Fabric A shows superior definition to both fabrics B and C. Fabrics B and C show some smearing in two colors (eg. black and red). Fabric A shows little or no smearing and thus shows better sharpness of print lines.

(3) Hand after printing

"Hand" of fabric A is rated fuller and smoother than fabric B. Fabric C shows equally soft "hand" as fabric A. These samples are rated by three independent observers.

(4) Color fastness properties

Color fastness to crocking is determined by AATCC Test Method 8-1974 and the data are shown in the following Table:

| | Crock fastness rating (5 = best, 1 = very poor) | | |
|---|---|---|---|
| | Fabric A | Fabric B | Fabric C |
| wet | 4.25 | 3.75 | 3.75 |
| dry | 3.75 | 3.0 | 3.25 |

EXAMPLE 12

The following experiment is conducted to determine the ability of the fabrics to prevent redeposition (or repel deposition) of oily materials and dirty soils which have been dissolved or dispersed in the wash liquor. The three pad bath formulations as described in Example 10 a, b and c are padded onto polyester/cotton (50/50) sheeting and then subsequently flash-cured at 205° C. for 20 seconds. The fabrics are then labeled A (formulation 10a), B (formulation 10b) and C (formulation 10c) and are subjected to the Celanese anti-soil redeposition test as described at the end of the specification. The comparative soil pick-up by the fabrics in the Launder-ometer is determined by means of the Hunter Reflectometer Model D-40, manufactured by Hunter Associates Laboratory, Inc., 5421 Briar Ridge Road, Fairfax, Va.

A value for whiteness (W) may be computed from these values by means of the following formula:

$$W = Y + 4(Z - y)(\%)$$

W = percent whiteness
Y = green reflectance
Z = blue reflectance

The objective of this test is to provide methods for measuring the whiteness retention of the polyester/cotton fabrics after the laundering procedures described above.

Data are reported in the following Table:

| Specimen | % Whiteness |
|---|---|
| A | 71.9 |
| B | 49.7 |
| C | 10.9 |
| control (untreated) | 72.8 |

From the data in the above Table, it is evident that fabrics B and C have lost some or most of their whiteness after the washings. This positively indicates that less soil is deposited from the wash liquor onto fabric A which is normally required by consumers of these fabrics.

EXAMPLE 13

The dimethylol co-carbamate obtained as described in Example 4 is applied on swatches of polyester/cotton sheeting material and cured. N-Methylol 2-methoxyethyl-carbamate which has not been treated by the process of this invention is applied too and cured on control swatches of polyester/cotton sheeting material. Additionally the fabrics are treated with formulations B and C using 40% strength dimethylol 4,5-dihydroxyethylene-urea as described in Example 10 b and c.

The swatches are flash-cured at 205° C. for 20 seconds.

The swatches have the following accelerator abrasion losses (1 minute at 3,000 rpm):

| Fabric treatment | Abrasion loss |
|---|---|
| 15% of dimethylol co-carbamate of Example 4, 50% strength solution | 3.5% |
| 15% of dimethylol 2-methoxyethyl-carbamate, 45% strength solution | 8.9% |
| 15% of dimethylol 4,5-dihydroxyethylene-urea, 50% strength solution (formulation 10b) | 10.2% |
| 10% of dimethylol 4,5-dihydroxyethylene-urea, 50% strength solution with 2% of silicone softener (formulation 10c) | 6.2% |
| none | 1.9% |

It is obvious that the dimethylol co-carbamate of the invention shows a reduced dusting propensity of the sheeting material (dusting in the sewing and fabric packaging areas).

EXAMPLE 14

A pad bath formulation is prepared from the following ingredients:

(a)

15.0% of dimethylol co-carbamate solution (50% solids) of Example 5
0.1% of p-octylphenol, ethoxylated with ten moles of ethylene oxide, as non-ionic wetting agent
0.2% of activated basic aluminum chloride . $9H_2O$
the balance being water.

The above is padded onto polyester/cotton (65/35) sheeting fabric of 120 g/m$^2$ at 70% wet pick-up from the bath.

The fabric is then dried and cured in a tenter frame at 205° C. for 20 seconds.

For comparison, samples are similarly padded with:

(b)

12.0% dimethylol 4,5-dihydroxyethylene urea (aqueous) solution (50% solids)

2.0% of a commercially available 35% anionic emulsion of dimethylpolysiloxane as softener
2.0% magnesium chloride hexahydrate
0.1% p-octylphenol, oxyethylated with ten moles of ethylene oxide
the balance being water.

In both cases the optimum type and amount of catalyst for the particular finish was chosen.

The fabric is dried and cured as described above (205° C. for 20 seconds).

The two samples are labeled A (formulation a) and B (formulation b) and tested essentially as described above.

A summary of the results is reported in the following table:

| | A (according to invention) | B (comparison with 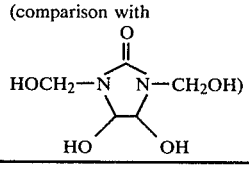 ) |
|---|---|---|
| Addition of softener | unnecessary | necessary |
| Handle | very soft | sandy |
| Printability of finished fabric | excellent | poor (handle hardened) |
| Fastness to chlorine (AATCC Scorch Test) | excellent | just acceptable |
| Absorbency Test | approx. 5–10 sec. | approx.3 min. |
| Soil redeposition | low | high |
| Formaldehyde odor (AATCC 112-1975) | 80 ppm | 550 ppm |
| Abrasion loss | 5% | 13% |

The table shows the superiority of the finish of the invention over the finish of the closest art. It will be noted that, despite the use of an expensive softener, the handle of sample B is inferior to that of sample A for which no softener was used. The shrink and wrinkle resistant characteristics are similar, and so is the degree of whiteness. These and various other results have therefore not been included in the table. There appears to be no property in which the finish of the invention is inferior to the finish of the art.

The comparative experiments described in Examples 9 to 14 illustrate the superiority of the compositions of the invention over the individual components. It is surprising that a mixture of two substances which individually give unsatisfactory results should give results which are at least satisfactory and in some respects excellent.

EXAMPLES 15 AND 16

Samples of a 50/50 polyester/cotton sheeting fabric (108 g/m$^2$) which has been bleached only are padded with an aqueous solution containing
150 g/l of finishing agent A (Example 15) or B (Example 16) as described below,
1.8 g/l of basic aluminum chloride and
1 g/l of a commercial non-ionic wetting agent.

The wet pick-up is 65%. The fabric is flash-cured in a tenter frame for 20 seconds at 205° C.

Finishing agent A consists of a 50% aqueous solution of a mixture of 9 parts of dimethylol-diethylene glycol monocarbamate and 1 part of dimethylolpolyethylene glycol (800)-monocarbamate (N,N-dimethylol monocarbamate of a polyethylene glycol of molecular weight 800).

Finishing agent B consists of a 50% aqueous solution of the same components in the weight ratio of 19:1 (95%, based on the weight of the carbamate mixture, of dimethylol-diethylene glycol monocarbamate and 5% dimethylol polyethylene glycol (800) monocarbamate).

The two samples, when tested essentially as described above, give the following results:

| | A (Example 15) | B (Example 16) |
|---|---|---|
| durable press rating (AATCC 124-1975) | 4.0 | 4.1 |
| shrinkage (warp and weft) | 0.8 × 1.1% | 0.7 × 1.0% |
| abrasion loss (1 min. at 3,000 r.p.m.) | 4.0% | 5.2% |
| formaldehyde odor (AATCC 112-1975) | 170 ppm | 205 ppm |

Celanese Antisoil Redeposition Test:
Apparatus: Lauder-ometer 60° C.
Celanese standard soil (should be mixed for 60 minutes once a week).
Specimens
2 samples 15 × 15 cm.

Fabrics are machine-washed prior to testing using a normal cycle according to the type of material.

1. All fabrics containing wool—40° C.
2. Tricots, circular knits and prints—50° C.
3. All woven fabrics—60° C.

Procedure:

1. Prepare soiling solution—16 g/l
2. Add 200 ml of soiling solution to Launder-ometer can and 10 steel balls
3. Place samples in cans, seal and rotate for 30 minutes
4. Remove samples and rinse in cool tap water
5. Machine-wash samples with 50 cc of a commercial household detergent using cold water—cold rinse low setting
6. Tumble dry.

We claim:

1. A finish for textiles containing, or consisting of, cellulose, which comprises an aqueous solution, of from 30 to 70 percent strength by weight, of a mixture of the conventionally formaldehyde-methylolated carbamates I and II $$R^1\text{-}(OCH_2-CH_2)_{9-100}-\overset{O}{\overset{\|}{C}}-NH_2 \qquad \text{I}$$

$$R^1\text{-}(\overset{R^2}{\overset{|}{O}}CH-\overset{R^3}{\overset{|}{C}}H)_{1-3}-\overset{O}{\overset{\|}{C}}-NH_2 \qquad \text{II}$$

where $R^1$ is hydrogen or alkyl of 1 to 4 carbon atoms and $R^2$ and $R^3$ is hydrogen, or one is hydrogen and the other is methyl, in the weight ratio I:II of from 12:1 to 1:20.

2. A process for the preparation of a textile finish as claimed in claim 1, by reacting a glycol or an alkylglycol of the formulae III and IV $$R^1\text{-}(OCH_2-CH_2)_{9-100}\,OH \qquad \text{III}$$

$$R^1\text{-}(\overset{R^2}{\overset{|}{O}}CH-\overset{R^3}{\overset{|}{C}}H)_{1-3}-OH \qquad \text{IV}$$

where $R^1$, $R^2$ and $R^3$ have the above meanings, with urea at above 100° C., so as to eliminate ammonia and give carbamates, and subsequent conventional methylolation with formaldehyde, wherein, in a first stage, the glycol or alkylglycol of the formula III is reacted to the extent of at least 50% with urea, in the absence of a catalyst, at from 130° to 160° C., to give the carbamate I, and in a second stage, carried out either in the presence of an ion exchanger, containing nickel ions, as the catalyst, at from 130° to 165° C., or in the absence of a catalyst at from 150° to 200° C., the carbamate mixture in the weight ratio I:II of from 12:1 to 1:20, is prepared by addition of the glycol or alkylglycol of the formula IV and further urea.

3. Use of a textile finish as claimed in claim 1 for the easy-care finishing of textiles which contain, or consist of, cellulose.

* * * * *